US006202943B1

(12) United States Patent
Evans et al.

(10) Patent No.: US 6,202,943 B1
(45) **Date of Patent: *Mar. 20, 2001**

(54) LIQUID DISPENSING DEVICES

(75) Inventors: Robert M. Evans, Clifton; William L. Klima, Stafford, both of VA (US)

(73) Assignee: EVNX Technologies, Inc., Stafford, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/372,143

(22) Filed: Jan. 13, 1995

Related U.S. Application Data

(63) Continuation-in-part of application No. 08/237,905, filed on May 4, 1994, now Pat. No. 5,797,522, which is a continuation of application No. 08/001,763, filed on Jan. 7, 1993, now Pat. No. 5,381,961, which is a continuation-in-part of application No. 07/987,147, filed on Dec. 8, 1992, which is a continuation-in-part of application No. 07/978,381, filed on Nov. 18, 1992, which is a continuation-in-part of application No. 07/974,106, filed on Nov. 10, 1992.

(51) Int. Cl.[7] ..... B05B 9/043

(52) U.S. Cl. ..... 239/333; 222/464.4

(58) Field of Search ..... 222/464, 382, 222/211, 383, 324, 526; 239/302, 329–334, 587.1–587.4, 588, 525; 285/160, 166, 184

(56) References Cited

U.S. PATENT DOCUMENTS

| | | | | |
|---|---|---|---|---|
| 179,416 | * | 7/1876 | Kennish | 215/11.1 |
| 1,959,102 | * | 5/1934 | Hummel | 222/464 X |
| 2,128,494 | * | 8/1938 | Morrow | 222/324 |
| 2,483,661 | * | 10/1949 | Neas | 222/4 |
| 2,494,837 | * | 1/1950 | Simmons | 239/333 X |
| 2,530,583 | * | 11/1950 | Nurkiewicz | 169/75 |
| 2,569,975 | * | 10/1951 | Cone | 169/72 |
| 2,920,798 | * | 1/1960 | Samuel | 222/464 |
| 3,173,710 | * | 3/1965 | Kinnison | 285/166 X |
| 3,247,360 | * | 4/1966 | Ponder | 219/436 |
| 3,282,510 | * | 11/1966 | Schwartz | 239/333 X |
| 3,411,648 | * | 11/1968 | Tichy | 215/164 |
| 3,547,296 | * | 12/1970 | Greenberg | 222/464 X |
| 3,667,655 | * | 6/1972 | Knieriem, Jr. | 222/464 |
| 4,083,476 | * | 4/1978 | Schwartz, Jr. | 239/333 X |
| 4,158,462 | * | 6/1979 | Coral | 285/184 X |
| 4,273,272 | * | 6/1981 | Blanc | 222/464 |
| 4,767,033 | * | 8/1988 | Gemperle | 239/333 X |
| 4,830,235 | * | 5/1989 | Miller | 222/464 |
| 4,940,152 | * | 7/1990 | Lin | 222/464 X |
| 5,083,686 | * | 1/1992 | Cady et al. | 222/464 |
| 5,195,664 | * | 3/1993 | Rhea | 222/464 |
| 5,215,227 | * | 6/1993 | Farner | 222/464 X |

FOREIGN PATENT DOCUMENTS

| | | | | |
|---|---|---|---|---|
| 655424 | * | 4/1929 | (FR) | 239/333 |
| 735659 | * | 8/1955 | (GB) | 222/211 |
| 317484 | * | 12/1988 | (JP) | 222/464 |

* cited by examiner

*Primary Examiner*—Lesley D. Morris
(74) *Attorney, Agent, or Firm*—Law Offices of William L. Klima, P.L.C.

(57) ABSTRACT

Liquid dispensing devices provided with tilting or bending pickup tubes for allowing substantially complete evacuation of the contents of the supply bottles. In preferred embodiments, the pickup tube is connected to a dispensing unit such as a sprayhead by a variety of different types of flexible connectors to allow tilting of the pickup tube. In other preferred embodiments, a semi-flexible pickup tube is weighted to cause bending of the tube with or without the addition of a flexible connector between the pickup tube and sprayhead.

15 Claims, 6 Drawing Sheets

FIG. 11
PRIOR ART
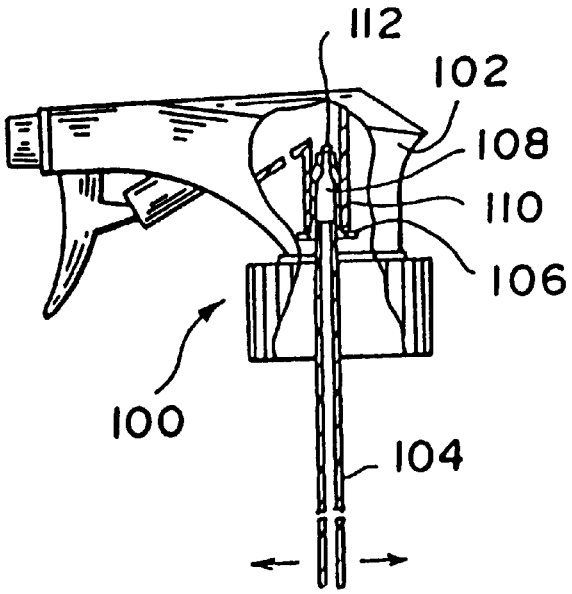
FIG. 12A
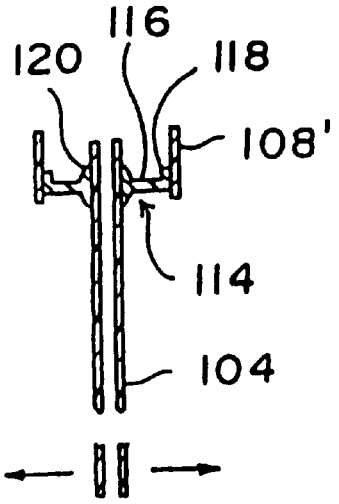
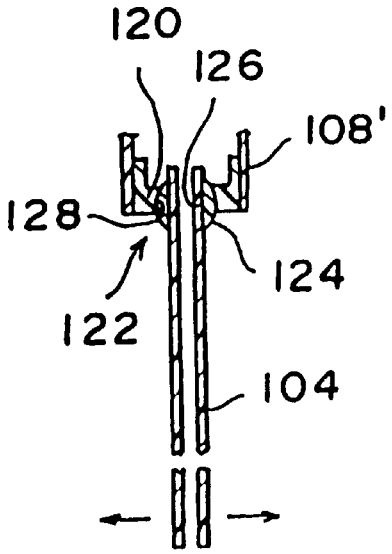
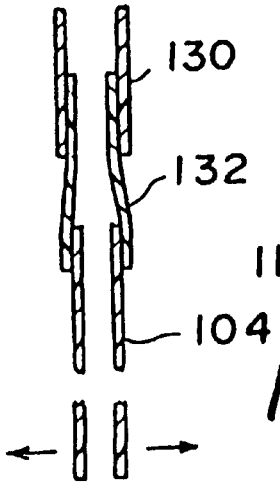
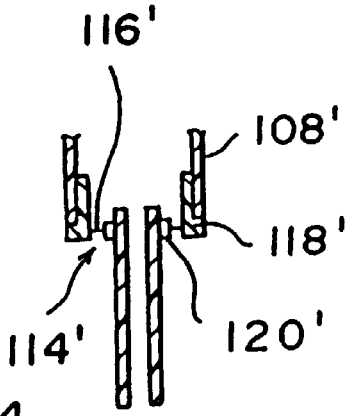
FIG. 12B
FIG. 13 FIG. 14A FIG. 15C
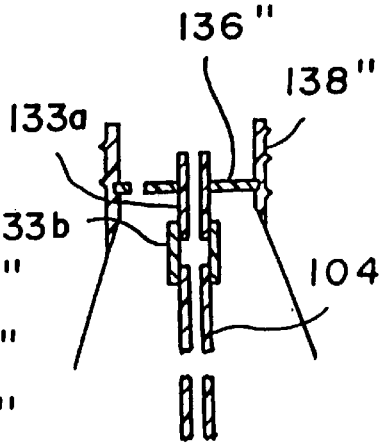
FIG. 14B
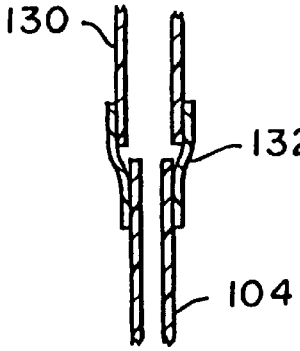
FIG. 12C
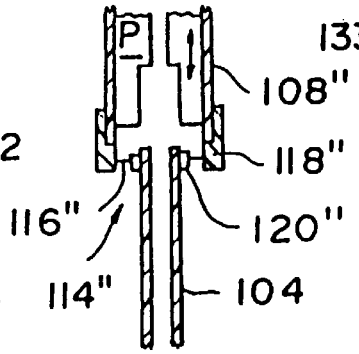
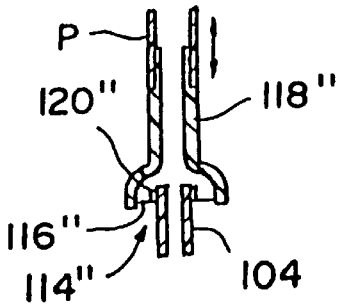
FIG. 12D
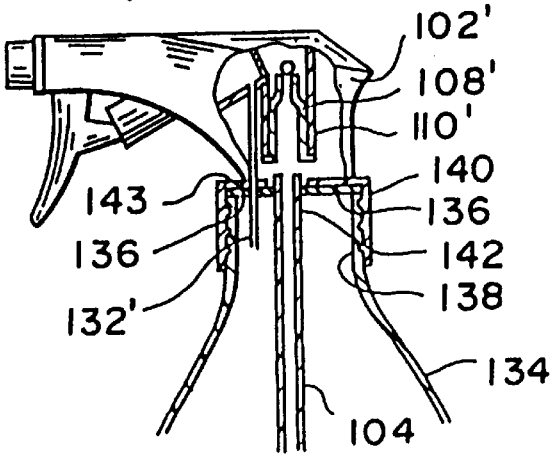
FIG. 15A
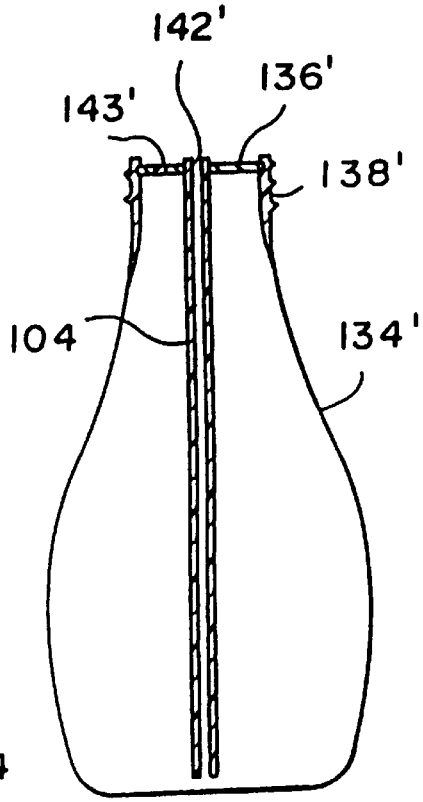
FIG. 15B FIG. 16
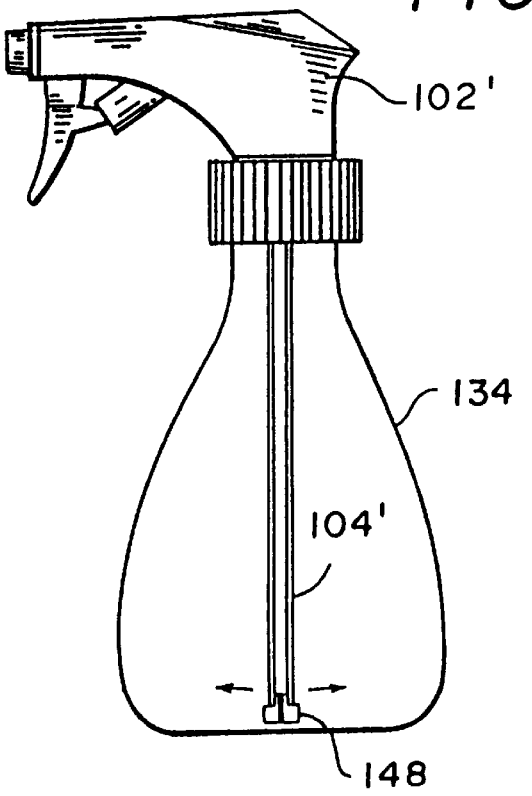
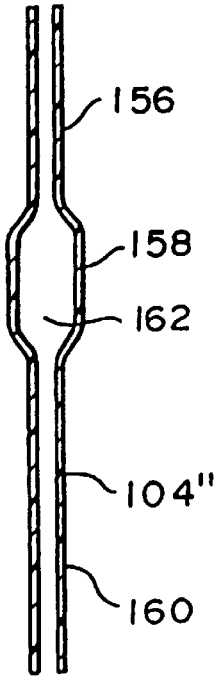
FIG. 19
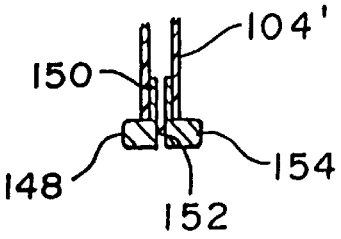
FIG. 17
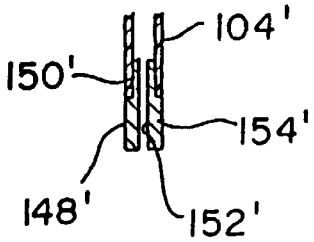
FIG. 18

LIQUID DISPENSING DEVICES

REFERENCE TO RELATED APPLICATIONS

This application is a Continuation of U.S. Patent application entitled LIQUID DISPENSING DEVICES, Ser. No. 08/001,763, filed on Jan. 7, 1993, issued as U.S. Pat. No. 5,381,961 on Jan. 17, 1995, which is a Continuation-in-Part of U.S. Patent application entitled "SPRAYER WITH SWIVELING SPRAY HEAD, Ser. No. 07/974,106, filed on Nov. 10, 1992; U.S. Patent application entitled "LIQUID PICKUP FOR LIQUID DISPENSER", Ser. No. 07/978,381, filed on Nov. 18, 1992; and U.S. Patent application entitled "LIQUID DISPENSER HAVING FLEXIBLE PICKUP", Ser. No. 07/987,147, filed on Dec. 8, 1992. Further, this is a Continuation-in-Part of U.S. Patent application entitled "AEROSOL SPRAY DISPENSERS", Ser. No. 08/237,905, filed on May 4, 1994, now U.S Pat. No. 5,797,522. All of these above applications are fully incorporated herein by reference.

FIELD OF THE INVENTION

The present application relates to liquid dispensing devices, particularly spray bottles having pump actuators and aerosol liquid dispensers.

BACKGROUND OF THE INVENTION

The prior art has addressed a need to have the pickup end of a pickup tube track a low point within a liquid reservoir, which low point migrates about the bottom of a container as the container is tipped.

U.S. Pat. No. 3,490,656, issued to Kenneth A. Taschner on Jan. 20, 1970, discloses a pickup tube for use in spray dispensing apparatus employing compressed gas propellant. The pickup tube is flexible along its entire length, and includes a weighted pickup terminal end.

U.K. Pat. Application No. 2,136,057A, published on Sep. 12, 1984, shows a pickup tube providing similar function to that of Taschner. The U.K. reference disclosed tube structure comprising series connected, hollow compartments communicating through common openings. Each compartment has an expanded center portion and a constricted waist, each waist being common to adjacent compartments. Flexure at the waists is cumulative, the result being that a length including a plurality of compartments enables considerable bending ability and flexibility. Thus, the pickup tube of the U.K. reference achieves bending even though the tube is not highly flexible along a continuous wall thickness length, as is provided in Taschner. The U.K. reference also discloses a weight disposed at the pickup end of the tube.

U.S. Pat. No. 5,119,974, issued to Fredrick J. Mann on Jun. 9, 1992, discloses a pickup tube selectively drawing liquid from a container for subsequent dispensing selectively from a high or low location within the container, dependent upon the upright orientation thereof.

None of the above inventions and patents, taken either singly or in combination, is seen to describe the instant invention as claimed.

SUMMARY OF THE INVENTION

Many liquid dispensers are mass produced for sale to the general public for storage and dispensing of a myriad of liquid products. It is generally considered desirable to provide conveniences and perceived advantages in such liquid dispensers, such as the ability of the dispenser to utilize substantially all of the liquid held in a container component thereof. One approach toward this end is to provide a liquid pickup device which tracks the liquid, particularly as the point of depletion is reached.

Important elements in the design of the liquid pickup device are simplicity and cost. While materials are known which provide the degree of flexibility required in the Taschner invention, these materials must also be able to resist deterioration in the often harsh chemical environment of the liquid being stored and dispensed. This combination may result in high expense.

Similarly, to form a tube in the elongated/bellows configuration seen in U.K. reference increases cost and manufacturing steps. The complicated structure of the Mann invention also increases complexity and cost.

The present invention seeks to retain the major advantages of these inventions while mitigating complexity and, especially, material and production costs. Given the extremely competitive nature of the container industry and the very large production runs therein, the importance of even small economies to a single container will be fully appreciated.

Since most liquid dispensers are used in an upright or in a substantially upright orientation, it becomes possible to forgo the extreme flexibility shown in the U.K. and Taschner references. Instead, it is desired to provide a pickup tube which tilts or bends (i.e. sways) as the container is tipped, maintaining the pickup end near the container bottom, immersed even in shallow remaining liquid.

The prior art fails to provide a pickup tube which maintains the pickup end thereof near the bottom of the container while accommodating sway, which sway enables the pickup tube to track low points within the liquid level.

The present invention addresses this need by the provision of a variety of different pickup tube and sprayhead combinations that provide tilting motion of the pick up tube relative to the sprayhead to accommodate sway. In a preferred embodiment, a flexible connection is provided between the pickup tube and sprayhead to provide relative tilting therebetween. In another preferred embodiment, a semi-flexible pick up tube is designed or provided with a weight to enable the pickup tube to sway when tilting the spray bottle by the effect of gravity. These features enable the pickup tube to seek the lowest point in the container, and a standard inexpensive semi-flexible pickup tube can be utilized in the assemblies. Further, the flexible connection between the pickup tube and sprayhead is preferably made without modification to either the standard sprayhead or the standard pickup tube, for example with an add on item. Alternatively, the standard connector component of a standard sprayhead can be modified or replaced with a flexible connection for the pickup tube without modification of the main component of the standard sprayhead.

The pickup tube may be provided from mass produced stock material. This material is preferably selected due to, in addition to cost considerations, the ability to resist chemical attack. Moreover, the pickup tube is optionally selected to be heavier than the liquid, so that the pickup tube sways under the influence of gravity. This also includes tubing which may be less dense but becomes denser when filled with liquid.

In alternative embodiments, a separate weight is attached to the semi-flexible pickup tube.

In further alternative embodiments, attachment of the respective components may be by resilient compression or tension gripping connections, snap connectors and/or by adhesive.

Accordingly, it is a principal object of the present invention to provide a liquid dispensing device having a tilting pickup tube to accommodate sway.

Another object of the present invention is to provide a liquid dispensing device having a pickup tube connected to a dispensing unit such as a sprayhead by means of a flexible connector to allow tilting of the pickup tube relative to the sprayhead to accommodate sway.

A further object of the present invention is to provide a liquid dispensing device having a semi-flexible pickup tube provided with a weight to allow tilting or bending of the pickup tube relative to the sprayhead to accommodate sway.

A still further object of the present invention is to provide a liquid dispensing device with a pickup tube maintained towards the bottom of a liquid container while enabling the pickup tube to tilt in response to gravity to accommodate sway.

BRIEF DESCRIPTION OF THE DRAWINGS

FIG. 11 is a side elevational view of a prior art spray bottle.

FIG. 12A is a detailed cross-sectional view of a connector portion of the conventional sprayhead shown in FIG. 11.

FIG. 12B is a detailed cross-sectional view of another embodiment of the flexible connector according to the present invention.

FIGS. 12C and 12D are detailed cross-sectional views of a further embodiments of the flexible connector according to the present invention.

FIG. 13 is a detailed cross-sectional view of a ball and socket flexible connector according to the present invention.

FIG. 14A is a detailed cross-sectional view of still another embodiment of the flexible connector according to the present invention.

FIG. 14B is a detailed cross-sectional view of an even further embodiment of the flexible connector according to the present invention.

FIG. 15A is a partial cross-sectional view and broken away view of a spray bottle with a modified sprayhead and flexible membrane connector.

FIG. 15B is a side elevational view of a spray bottle/pickup unit for use with a sprayhead not provided with a pickup tube.

FIG. 15C is a partial side elevational view of another liquid bottle/pickup tube unit.

FIG. 16 is an elevational side view of a spray bottle according to the present invention having a weight semi-flexible pickup tube.

FIG. 17 is a detailed cross-sectional view of the distal end and weight.

FIG. 18 is a detailed cross-sectional view of the distal end of the pickup tube provided with another embodiment of the weight.

FIG. 19 is a cross-sectional view of another embodiment of a weighted pickup tube.

DETAILED DESCRIPTION OF THE PREFERRED EMBODIMENTS

Figure 2:
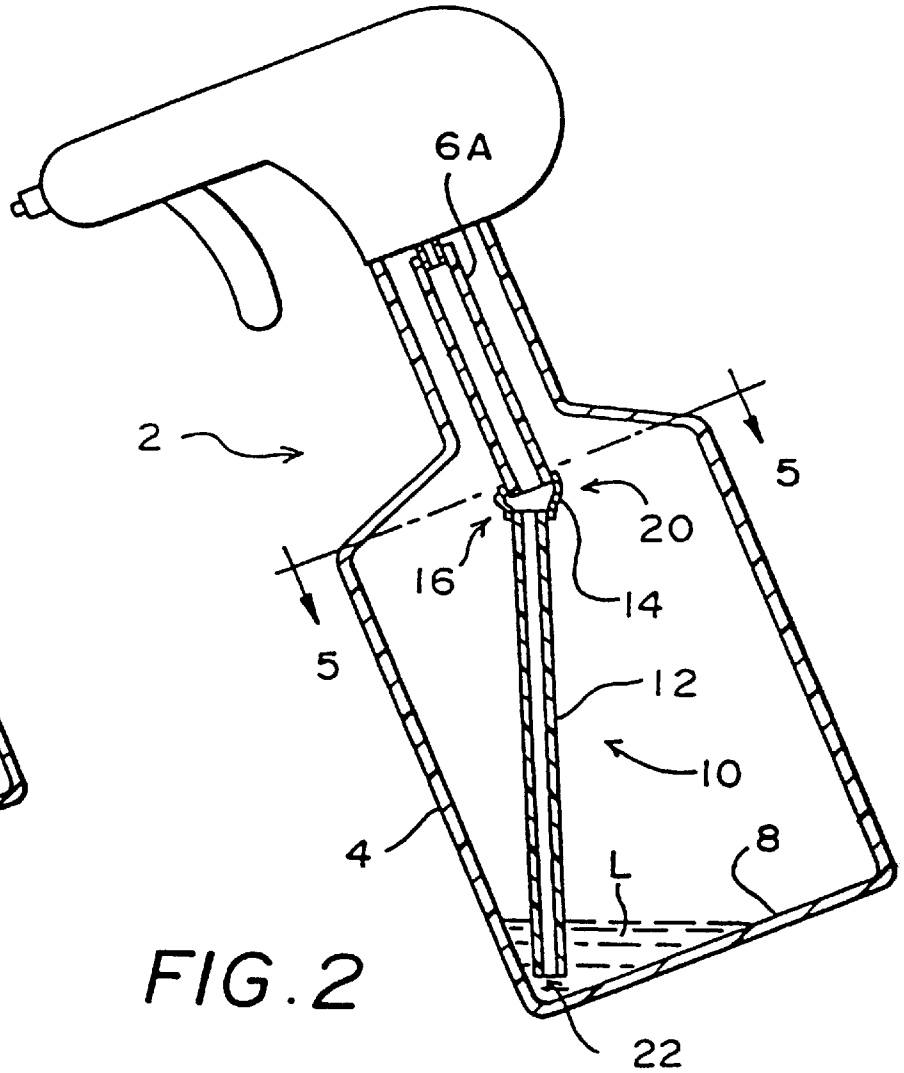
FIGS. 1 and 2 are side cross-sections views of an embodiment of the invention in its environment.
Figure 1:
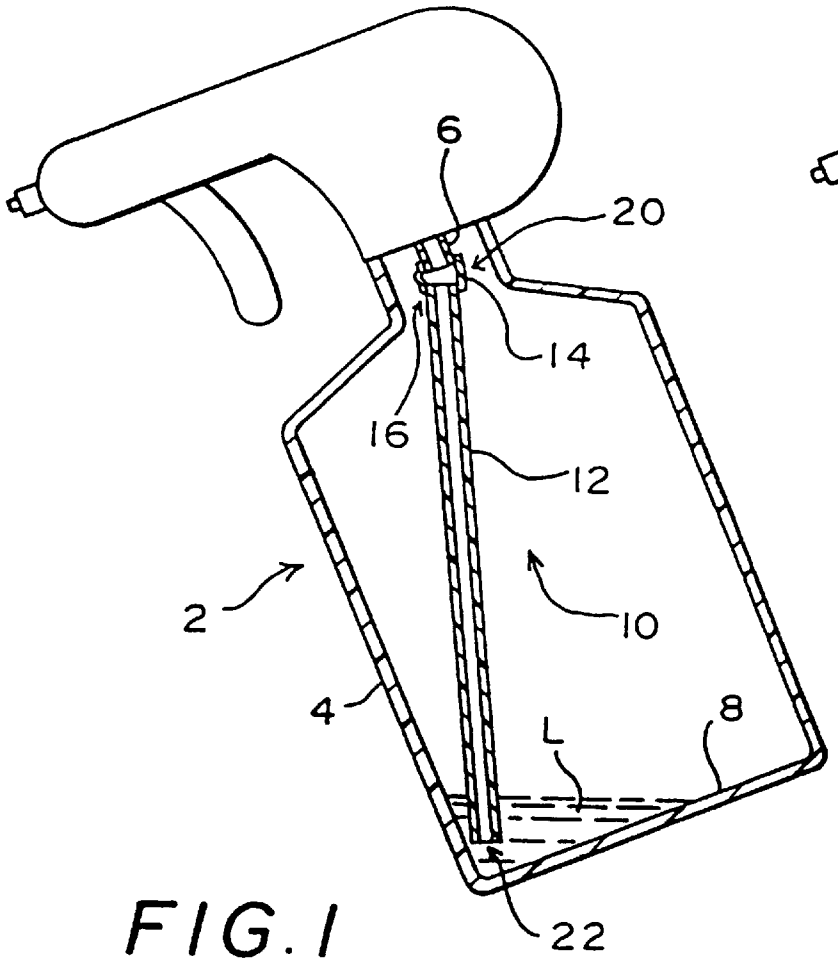
Figure 3:
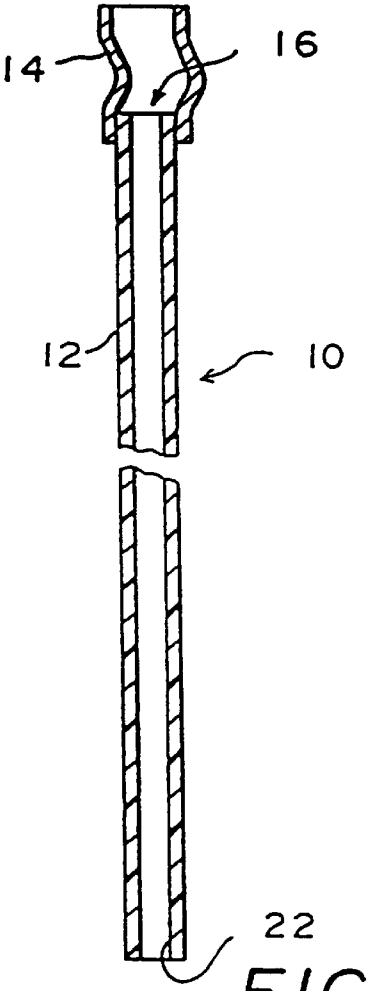
FIG. 3 is a side cross-sectional detail view of a lower portion of the pickup tube shown in FIGS. 1 and 2.

An embodiment of the present invention is seen in FIGS. 1 and 2. A liquid dispensing device, as represented by a sprayer 2, comprises a pickup tube 10, which is disposed within a container 4 of the sprayer. As seen in FIG. 3, pickup tube 10 comprises a first or main tubular section 12, which provides substantially most of the length of pickup tube 10, and a second, short section 14 of flexible tubing. The short, flexible section 14 is resilient, so that it is easily slipped over, and resiliently grips, a proximal end 16 of main tubular section 12. If desired, short, flexible section 14 can be fused to the main tubular section 12, as by ultrasonic welding, or other suitable techniques.

Figure 4:
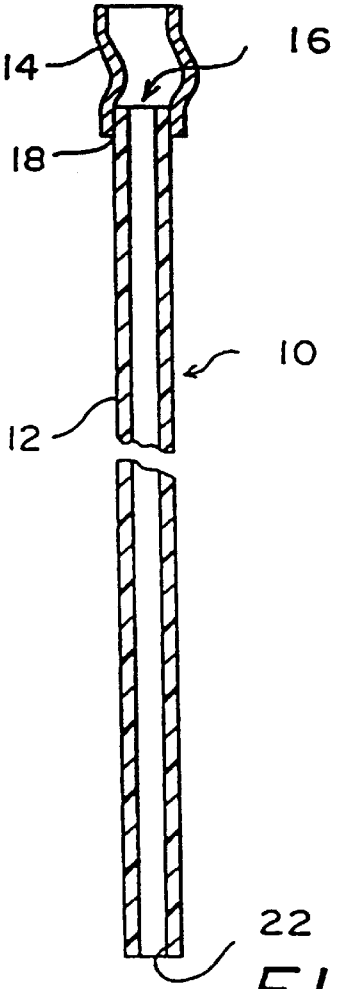
FIG. 4 is an alternative embodiment of the invention as seen in FIG. 3.

The short, flexible section 14 also slips over a connection tube 6 provided as part of sprayer 2. Resilient grip of short flexible section 14 securely holds pickup tube 10 to the sprayer 2. If desired, and as shown in FIG. 4, adhesive material 18 could be provided to further improve bonding of flexible section 14 to main section 12. In contrast to use of adhesive 18, shown in FIG. 4, fusing eliminates a constituent material, there being only the original main and short, flexible sections 12,14, as reflected in FIG. 3.

Figure 5:
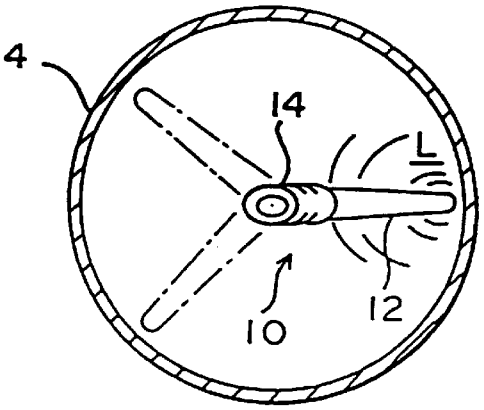
FIG. 5 is a top plan environmental view of the invention, taken along line 5—5 of FIG. 2.

Again referring to FIG. 1, it will be seen that due to flexibility, section 14 provides a flex joint 20 about which main tubular section 10 pivots universally, within limits dictated by container 4. This is also seen in top plan view in FIG. 5. Pickup tube 10 is shown inclined relative to container 4 in FIGS. 1 and 2, and could incline in an opposite direction as indicated in dashed lines (FIG. 1). Inclination may be affected by design of the sprayer 2 in that an elongated connection tube 6A could bend slightly, thus, altering bending characteristics of the combination of connection tube 6A and pickup tube 10. Pickup tube 10 will continue to perform as described, although its length may be adjusted to accommodate bending (not shown) of connection tube 6A.

The main tubular section 12 terminates in an open pickup end 22 facing downwardly and accepting flow of liquid L thereinto. By the pickup tube 10 constantly seeking the lowest point in response to gravity, pickup end 22 is submerged in liquid L substantially until depletion.

Inclination of pickup tube 10 relative to container 4 is, as mentioned, responsive to gravity. To enhance the ability of pickup tube 10 to respond independently of an influence of the liquid L being dispensed, it may prove desirable to increase density of the main tubular section 12. This may be accomplished in two ways. One is selection of a material known to be of greater density than that of liquid L. It may, therefore, be desirable to form main tubular section 12 of metal, glass, ceramic material, or a dense synthetic polymer. Homogenous materials may be enhanced, as by embedding a denser material therein, an example being the addition of glass into a polymer, or the incorporation of metal into a polymer or other material.

Figure 6:
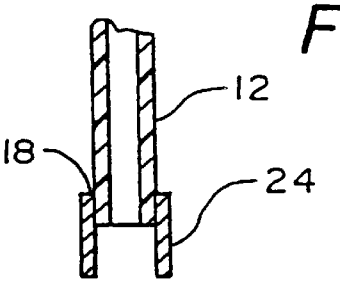
FIGS. 6, 7, 8 and 9 are cross-sectional detail views of alternative embodiments of a weight attached to the pickup tube.

A second approach is to attach a separate weight to main tubular section 12. In keeping with the construction of pickup tube 10, that being sections of cut tubular material, one embodiment of a weight 24 provides a section of cut metal tubing, seen in FIG. 6. In this embodiment, weight 24 is located exterior of main tubular section 12. Although weight 24 may be friction fit, adhesive material 18 may be employed to secure attachment.

Figure 7:
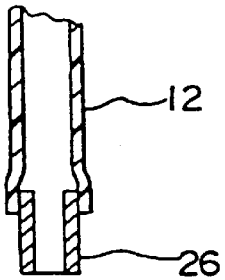

In a second embodiment, shown in FIG. 7, weight 26 is of lesser diameter than main tubular section 12. Given a weight 26 being attached within main tubular section 12, then main tubular section 12 may be made from a resilient plastic polymer, in which case resilience of the polymer enables a reasonably secure friction fit to weight 26. If weight 26 is metals it will more easily resist compression from this fit, unlike the previous embodiment wherein the innermost member comprised plastic, which lacks suitable resistance to compression.

Figure 8:
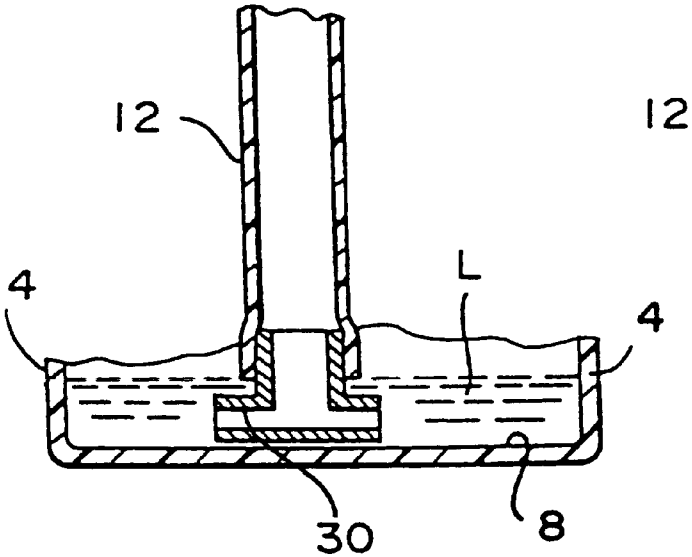

If the pickup tube 10 is designed to approach the floor 8 of container 4 at close proximity, such proximity could obstruct open end 22. As seen in FIG. 8, a weight 28 having lateral ports 30 will pick up liquid L at a very low level while accommodating the minimal clearance.

Figure 9:
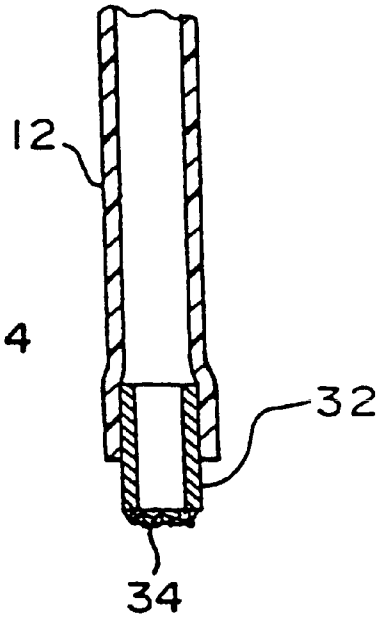

As seen in FIG. 9, a weight 32 is provided wherein a screen 34 is incorporated, thus enabling filtering of liquid L prior to induction into the sprayer 2. This feature is advantageous in situations wherein blockage of sprayer 2 is possible due to the nature of liquid L.

Figure 10:
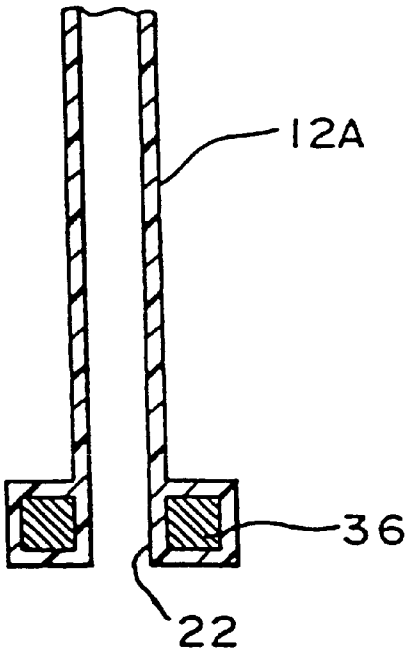
FIG. 10 is a cross-sectional detail view of a novel pickup tube showing an alternative embodiment wherein a weight is formed integrally therewith.

In a still further alternate embodiment, as seen in FIG. 10, main tubular section 12A is formed to surround a weight 36. This arrangement protects weight 36, enabling selection of a material forming weight 36 which might adversely react with liquid L.

The short, flexible section 14 is preferably made from a highly flexible and chemically resistant material. Silicone rubber-like material has served well in this regard, and is commercially available in forms resistant to many commonly used solvents and vehicles. Silicone is highly resilient, and provides secure resilient grip when slipped over an object. It also can accommodate sharp bends and resists kinking.

It will thus be seen that an uncomplicated pickup tube 10 can be made from butting sections of inexpensive tubular stock material. The resultant pickup tube has a flex joint 20 providing desired swiveling, and is sufficiently rigid along most of its length as to maintain pickup end 22 in close proximity to the container floor 8. The main tubular section 12 is provided with sufficient mass or density to respond satisfactorily to gravity, enabling the sprayer 2 to be operated successfully at orientations other than vertical.

Flexible Connectors

A series of embodiments according to the present invention involves providing a flexible connector between the dispensing unit (e.g. sprayhead) and pickup tube to allow for tilting of the pickup tube relative to the sprayhead to accommodate sway during operation of the liquid dispensing device such as a spray bottle.

A conventional sprayhead and pickup tube assembly 100 for a spray bottle is shown in FIG. 11. The assembly 100 comprises a sprayhead 102 and semi-rigid pickup tube 104. The proximal end of the semi-rigid pickup tube 104 is received within a rigid connector 106. The rigid connector 106 having a suction chamber 108 is received within cylindrical housing 110. An upper portion of the rigid connector 106 is provided with a ball check valve 112.

The proximal end of the pickup tube 104 is forced fit into the rigid connector 106 by controlling the dimensions of the outer diameter of the pickup tube 104 and the inner diameter of the rigid connector 106 providing a slight interference fit connection therebetween. The interference fit connection allows the pickup tube 104 to be forced fit into the rigid connector 106 of the sprayhead 102 during assembly, and prevents separation of these component during the useful life of the spray bottle.

An embodiment of a flexible connection between the pickup tube 104 and the sprayhead 102 is illustrated in FIG. 12A. In this embodiment a modified cylindrical suction chamber 108' having a greater diameter than the suction chamber 108 in the sprayhead 102 illustrated in FIG. 1 is provided.

A flexible membrane connector 114 is provided for connecting the pickup tube 104 to the cylindrical suction chamber 108' in a manner to allow tilting of the pickup tube relative to the sprayhead. The flexible membrane connector 114 comprises a flexible web portion 116 connecting an outer compression sealing ring 118 to an inner tension sealing ring 120. The flexible membrane connector 114 also provides a liquid seal between the pickup tube 104 and sprayhead for proper operation of the pump assembly. Thus, the flexible membrane connector 114 must properly seal therebetween by the type of sealing connections selected and/or through the use of adhesive.

The flexible web portion 116 is made so as to be sufficiently flexible to allow tilting of the pickup tube 104 relative to the sprayhead. Preferably, the flexible membrane is made sufficiently flexible to allow the pickup tube 104 to tilt relative to the sprayhead under the influence of gravity under the weight of the pickup tube 104 alone (i.e. no weight added to pickup tube) to reduce manufacturing, assembly, and materials costs.

The flexibility of the flexible web portion 116 is controlled by material thickness, diameter, and composition. Thus, a proper material and thickness must be selected to provide proper tilting operation of the pickup tube relative to the sprayhead. Further, the material should be selected to withstand chemical attack and wear during the operational lifetime of the spray bottle. Materials used could come from a variety of readily available stock materials such as latex, teflon, neoprene, silicone, etc., or combinations thereof.

The outer compression sealing ring 118 connects the flexible membrane connector 114 to the suction chamber 108, typically having a cylindrical configuration. Specifically, the outer compression ring fits within the inner diameter of the suction chamber 108', and seals against the inner wall thereof by means of compression.

The inner tension sealing ring 120 connects to the pickup tube 104, typically having a cylindrical configuration. Specifically, the inner tension sealing ring 120 fits around the outer diameter of the pickup tube 104 at its proximal end, and seals against the outer wall thereof by means of tension.

The flexible web portion 116, the outer compression sealing ring 118 and inner tension sealing ring 120 can be made of a one piece construction, such as by molding elastic material, or can have a composition construction. For example, the outer compression sealing ring 118 and inner tension sealing ring 120 can be made as separate ring components 118' and 120', as shown in FIG. 12B, and then connected to the flexible web portion 116'. In such an embodiment, the rings 118 and 120 can be made of metal (e.g. stainless steel, anodized aluminum), plastic or other suitable material with a flexible material, such as elastomeric material, forming the flexible web portion 116'. Further, the flexible web portion 116' may be made of a composite material or multilayer film material tailored to be both flexible and chemically resistent.

The diameter of the suction chamber 108' should be sufficiently great so that there is no contact of the proximal end of the pickup tube 104 with the suction chamber 108', which would inhibit the desired tilting/swaying of the pickup tube 104 relative to the sprayhead. Further, increasing the diameter of the suction chamber 108' increases the flexibility of the flexible connector.

A further embodiment of a flexible membrane connector 114" is shown in FIG. 12C. In this embodiment, the flexible membrane connector 114" comprises a flexible web portion 116", an outer tension sealing ring 118" and an inner tension sealing ring 120". The outer tension sealing ring 118" seals against the outer surface of the suction chamber 108" by means of tension, and the inner tension sealing ring 120" seals against the outer surface of the proximal end of said pickup tube 104.

In the embodiments shown in FIGS. 12C and 12D, a piston P for the pump mechanism moves up and down as indicated by the arrow. In the conventional sprayhead of this type, the piston P is provided with an opening for receiving and rigidly connecting to the proximal end of the pickup tube, thus, the pickup tube moves up and down during operation. However, in the embodiment shown in FIG. 12C, the pickup tube 104 is no longer rigidly connected to the piston P due to the use of the flexible membrane connector 114". This may be significant with respect to the substantially complete evacuation of the liquid bottle, since the up and down movement of the distal end of the pickup tube may interfere with the evacuation of a significant level of liquid. Specifically, in the conventional arrangement the distal end of the pickup tube would pickup air as it moves upwardly during the pumping stroke withdrawing the distal end from the remaining fluid level causing the suction of air into the pickup tube and impairing the pumping operation.

Another embodiment of the flexible connection according to the present invention is shown in FIG. 13 as a ball and socket connector 122.

The ball and socket connector 122 comprises a ball 124 having an opening 126 therein sealingly disposed within a socket 128. The ball 124 seals to the proximal end of the pickup tube 104, and socket 128 seals to the suction chamber 108'.

A further embodiment of the flexible connector according to the present invention is shown in FIG. 14A. In this embodiment, a different type of conventional sprayhead is provided a downtube 130 wherein suction is created to draw up liquid through the pickup tube 104. A flexible section of tubing 132 connects the pickup tube 104 to the downtube 130. Specifically, one end of the flexible section of tubing 132 is fitted inside the end of the down tube 130, and an opposite end is fitted around the proximal end of the pickup tube 104. The flexible section of tubing 132 must be selected to be sufficiently flexible to allow the pickup tube 104 to adequately tilt relative to the sprayhead. For example, a short length of silicone tubing would adequately seal and provide the flexibility necessary to allow proper tilting functioning.

An alternative to the flexible tubing embodiment is shown in FIG. 14B. In this embodiment, one end of the flexible section of tubing 132 is fitted around the outside of the downtube 130, and an opposite end is fitted around the outside of the proximal end of the pickup tube 104. For the same piece of tubing (i.e. same material and wall thickness), the configuration shown in FIG. 14A appears to provide a more flexible connection than the configuration shown in FIG. 14B under limited testing.

The flexible section of tubing 132 can be made from cutting a length of stock tubing and subsequently assembling the pickup tube and sprayhead. Alternatively, a layer of elastomeric material such as neoprene can be formed between said pickup tube and sprayhead, specifically the suction chamber, to define said flexible section of tubing 132, for example by a dipping operation.

A still further embodiment of the flexible connector according to the present invention is shown in FIG. 15A. In this embodiment, a sprayhead 102' is modified with a downtube 132' for providing air into the liquid bottle as liquid is depleted from the liquid bottle 134 during operation. The downtube 132' can extend from a conventional air port present in all sprayheads of this type. A flexible membrane 136 or gasket is provided between the sprayhead 102' and the liquid bottle 134. Specifically, the flexible membrane 136 is gripped around its perimeter by an upper portion of neck 138 of the liquid bottle 134 and a lower surface portion of a cap 140. Further, the flexible membrane 136 can be a separate unit or connected in some manner to the cap 140 and/or the bottle neck 138'.

The proximal end of pickup tube 104 is received within an opening 142 and downtube 132 is received within an opening 143 in flexible membrane 136. Specifically, the proximal end of the pickup tube 104 extends through the opening 142 and is retained therein during operation. The flexible membrane 136 is made of a material selected to be sufficiently flexible to allow tilting of the pickup tube 104 relative to the sprayhead due to the influence of gravity on the pickup tube 104.

The proximal end of the pickup tube 104 is positioned sufficiently below the rigid connector 106' and the suction chamber 108 to allow tilting of the pickup 104 without coming into contact therewith. The rigid connector 106' is disabled in the modified sprayhead 102' no longer serving as a connector between the pickup tube 104 and sprayhead 102', however, it remains since it is provided with the ball check valve 112' to allow proper operation of the pump assembly of the sprayhead 102'.

The modified sprayhead 102' must also be provided with sealing means for sealing the joint between the sprayhead 102' and the cap 140, since none is provided in the conventional sprayhead shown in FIG. 11. Preferably, a sealing means is provided which still allows rotation of the cap 140 relative to the sprayhead 102' such as an elastic sealing washer.

In an alternative embodiment, the pickup tube 104 and downtube 132' are combined into a one piece tube structure having a liquid passageway and air passageway with appropriate modification of the spray head to link these passageways with the suction chamber and air port in the conventional sprayhead.

Another flexible membrane embodiment is shown in FIG. 15B. In this embodiment, the pickup tube 104 and liquid bottle 134' are provided as one unit. The pickup tube 104 is flexibly connected to the liquid bottle by a flexible membrane 136', and the flexible membrane 136' is connected to the neck 138' of the liquid bottle 134'. The flexible membrane 136' can be permanently or removably attached to the neck 138' by adhesive, welding, snap connection, etc., or combinations thereof. Alternatively, the flexible membrane could be replaced with a rigid connector such as a plastic circular plate, and tilting or bending of the downtube could be achieved with a weighted pickup tube such as the ones described hereinbelow.

A rigid membrane embodiment is shown in FIG. 15C. In this embodiment, a rigid membrane 136" is provided with a semi-rigid or rigid coupler tube 133*a*. A flexible connection is provided between the downtube 104 and the coupling tube 133*a* by means of a section of flexible tubing 133*b*. The upper end of the coupling tube 133*a* releasably connects into the rigid coupling of the conventional sprayhead 102, shown in FIG. 11.

A conventional sprayhead would need to be modified in order to properly interface the liquid and air passageways of the spayhead into the liquid bottle 134'. For example, the sprayhead shown in FIG. 15A would be suitable.

This embodiment provides a number of important advantages including a spill-proof and somewhat child-proof bottle even when the sprayhead is removed, since limited quantities of liquid could flow from the pickup tube 104 or opening (i.e. restricted flow) when the liquid bottle, as opposed to the entire neck being open in conventional arrangements.

Further, a modified spray head without a connected pickup tube could be readily transferred from one bottle to the next. This would make it much more likely for consumers to reuse a sprayhead over numerous times while purchasing liquid bottles with connected pickup tubes sealed by a removable cap for storage and display during sale. Thus, the consumption and waste of sprayheads and materials utilized in the production thereof would be greatly reduced.

The use of flexible connectors with conventional or novel sprayheads provides a number of other possible advantages. For example, a flexible connector can be provided for increasing the volume of the suction chamber to provide a liquid reservoir. The liquid stored in the reservoir can be consumed during intermittent periods of upside down operation of the spray bottle without the occurrence of drawing air and failure of the pumping operation which readily occurs with conventional sprayheads.

Weighted Semi-Flexible Pickup Tube

An embodiment of a weighted semi-flexible pickup tube is shown in the embodiment of the spray bottle shown in FIG. 16. In this embodiment, a sprayhead 102' is connected to a liquid bottle 134 with a pickup tube 104 extending from the sprayhead 102' down into the liquid bottle 134. Further, a weight 148 is disposed at the distal end of the pickup tube 104.

The pickup tube 104 is made of semi-flexible plastic tubing of a type that is standard with most spray bottles utilized in the market place today. The semi-flexible plastic tubing of this type does not substantially move under the influence of gravity when tilting a conventional bottle. In order to provide a tilting or bending the semi-flexible pickup tube made with this type of tubing, the pickup tube must be weighted in some manner such as the embodiments shown in FIGS. 16–19.

The use of semi-flexible tubing verses a flexible tubing is very desirable for the following reasons. Since this type of semi-flexible tubing is being utilized currently to make pickup tubes in conventional spray bottles, it is readily available and can be adapted to the invention with little modification. Further, this type of tubing is significantly less expensive than flexible types of tubing such as silicone tubing. In addition, the semi-flexible tubing currently available allows for secure connections with the sprayhead whereas more flexible types of tubing can more easily pull off or from a fluid connector.

Further, the semi-rigid downtube due to its somewhat rigid nature maintains the distal end in close proximity to the bottom of the spray bottle in contrast to flexible type tubing wherein the distal end is substantially free to move around and possibly tangle up or contact with the inside of the liquid bottle and impair its movement during tilting of the bottle. In contrast, the semi-flexible pickup tube maintains the entire length of the pickup tube, particularly its distal end, from contacting the inner wall of the bottle in any significant manner that may impair movement thereof. Specifically, due to the semi-rigid properties of the desired pickup tube, the semi-rigid pickup tube is somewhat self-centering within the liquid bottle even when weighted.

In the embodiment shown in FIG. 16, the proximal end of the semi-flexible pickup tube 104' is rigidly connected to the sprayhead 102', thus, the semi-rigid pickup tube bends due to the influence of gravity acting on both the mass of the pickup tube and the weight 148. The resiliency of the pickup tube 104' must be overcome in order for proper tilting or bending functioning of the pickup tube. The plastic material of the semi-flexible pickup tube 104', diameter, wall thickness and length should be properly selected to allow sufficient tilting and throw of the distal end within the liquid bottle.

In alternative embodiments of the weighted pickup tube, a weighted pickup tube having a stiffness in the range of semi-rigid to rigid can be attached to the sprayhead by a flexible connector. The combination of both a weighted pickup tube and a flexible connector operationally connecting the pickup tube and sprayhead should provide a pickup tube that readily tilts and reacts quickly to changes in tilt angle and direction of the spray bottle such as when a person operating the spray bottle is quickly working with the spray bottle at varying angles and orientations thereof.

A detailed view of the weight 148 is shown in FIG. 17. The weight 148 is provided with a tubing connector section 150 for attachment to the distal end of the pickup tube 104' with a liquid passageway 152 extending through the tubing connector section 150 and main portion 154.

An alternative embodiment of a distal end weight is shown in FIG. 18. The main portion 154' of the weight is the same diameter as the diameter of the pickup tube 104' in this embodiment.

Other ways of weighing the pickup tube can be suitably achieved. For example, one or more weights can be added at different positions along the length of the pickup tube either by connecting weights to the outside diameter of the tube, embedding weight in the material of the tube, providing sections of weighted conduit at one or more positions along the pickup tube. Further, the pickup tube can be made without the addition of weight of different material by selecting sufficient density, stiffness, wall thickness, length, distribution of mass (i.e. heavier towards distal end), in order for the pickup tube to bend sufficiently under its own weight to cause suitable bending functioning.

Another embodiment of a weight pickup tube 104" is shown in FIG. 19. In this embodiment, the pickup tube 104" comprises an upper section 156, a middle section 158, and a lower section 160. The middle section 158 is defined by an expanded diameter section of tubing providing a reservoir for liquid. The reservoir 162 builds up a mass of fluid, which acts as a weight when the fluid level within the liquid bottle drops below the level of the reservoir 162 (i.e. fluid buoyancy removed) to cause tilting of the pickup tube under the influence of gravity.

It is to be understood that the present invention is not limited to the embodiment described above, but encompasses any and all embodiments within the scope of the following claims.

We claim:

1. A spray bottle dispensing device, comprising:

a spray bottle having a neck with an opening and a bottom;

a sprayhead connected to said neck of said spray bottle, said sprayhead being a pump type sprayhead having a suction chamber;

a one-piece plastic pickup tube flexibly connected by a flexible conduit to said sprayhead, said pickup tube having a length so as to extend from said sprayhead to a position in close proximity to said bottom of said spray bottle, said pickup tube being substantially rigid, said pickup tube having a distal end and arranged so that said distal end swings placing and maintaining said distal end in close proximity to said bottom of said spray bottle due to influence of gravity to accommodate tilting of the spray bottle dispenser during operation and enable substantial or complete evacuation of contents of said spray bottle, said pickup tube being configured to pivot universally within limits dictated by the container; and wherein said pickup tube is flexibly connected to said sprayhead by a flexible connector comprising a flexible membrane, said flexible membrane connector provided with a connector portion for accommodating and sealing with a proximal end of said pickup tube.

2. A device according to claim 1, wherein said pickup tube is weighted by providing a weight at said distal end of said pickup tube to enhance swinging action of said pickup tube.

3. A device according to claim 1, wherein said pickup tube is made without addition of weight to bend sufficiently under its own weight to cause suitable bending functioning.

4. A device according to claim 2, wherein said weight is made of at least one selected from the group of metal and plastic.

5. A device according to claim 1, wherein said pickup tube is connected to said sprayhead by a flexible member to provide tilting of said pickup tube relative to the spray bottle dispenser during operation.

6. A device according to claim 5, wherein said pickup tube is made of a denser material relative to liquid stored in said spray bottle to enhance swinging action of said pickup tube.

7. A device according to claim 5, wherein said pickup tube is provided with a weight to enhance swinging action of said pickup tube.

8. A device according to claim 1, wherein said flexible membrane is defined by a membrane disc sealing a cylindrical end portion of said suction chamber of said sparyhead.

9. A device according to claim 8, wherein said membrane disc is provided with an inner tension ring positioned around said opening in said membrane disc and connecting with said pickup tube in a manner to ensure proper sealing with a proximal end of said pickup tube.

10. A device according to claim 9, wherein said membrane disc is provided with an outer compression ring positioned around a perimeter of said membrane disc in order to connect to and seal with said cylindrical portion of said suction chamber of said sprayhead.

11. A device according to claim 9, wherein said membrane disc is provided with an outer tension ring positioned around a perimeter of said membrane disc in order to connect to and seal with said cylindrical portion of said suction chamber of said sprayhead.

12. A flexible connector for connecting a pickup tube to a dispensing unit of a liquid dispensing device, said flexible connector comprising;

first connector means for connecting said flexible connector to said pickup tube;

second connector means for connecting said flexible connector to said dispensing unit; and a flexible connection means disposed between said first connector means and said second connector means, said flexible connection means comprising a thinner portion relative to at least one of said first connector means and said second connector means for allowing tilting of the said pickup tube relative to said dispensing unit.

13. A flexible connector according to claim 12, wherein said flexible connector has a one-piece molded construction.

14. A spray bottle dispensing device, comprising:

a spray bottle having a neck with an opening and a bottom;

a sprayhead connected to said neck of said spray bottle, said sprayhead being a pump type sprayhead having a suction chamber;

a one-piece plastic pickup tube flexibly connected by a flexible conduit to said sprayhead, said pickup tube having a length so as to extend from said sprayhead to a position in close proximity to said bottom of said spray bottle, said pickup tube being substantially rigid, said pickup tube having a distal end and arranged so that said distal end swings placing and maintaining said distal end in close proximity to said bottom of said spray bottle due to influence of gravity to accommodate tilting of the spray bottle dispenser during operation and enable substantial or complete evacuation of contents of said spray bottle, said pickup tube being configured to pivot universally within limits dictated by the container; and wherein said pickup tube is connected to said sprayhead by a flexible member to provide tilting of said pickup tube relative to the spray bottle dispenser during operation; and wherein said pickup tube is flexibly connected to said sprayhead by a flexible connector comprising a flexible membrane, said flexible membrane connector provided with a connector portion for accommodating and sealing a proximal end of said pickup tube.

15. A flexible connector according to claim 14, wherein said flexible connector has a one-piece molded construction.

* * * * *